US009605816B2

(12) United States Patent
Lin et al.

(10) Patent No.: US 9,605,816 B2
(45) Date of Patent: Mar. 28, 2017

(54) PORTABLE LED LIGHT

(71) Applicant: Shenzhen Dokocom Energy Technology Co., Ltd, Shenzhen, Guangdong (CN)

(72) Inventors: Peilin Lin, Guangdong (CN); Yaoyi He, Guangdong (CN)

(73) Assignee: SHENZHEN DOKOCOM ENERGY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/900,611

(22) PCT Filed: Jan. 16, 2015

(86) PCT No.: PCT/CN2015/070820

§ 371 (c)(1),
(2) Date: Dec. 21, 2015

(87) PCT Pub. No.: WO2016/106859

PCT Pub. Date: Jul. 7, 2016

(65) Prior Publication Data

US 2016/0327221 A1 Nov. 10, 2016

(30) Foreign Application Priority Data

Dec. 31, 2014 (CN) ..... 2014 1 0849074

(51) Int. Cl.

| | |
|---|---|
| ***F21L 4/04*** | (2006.01) |
| ***F21V 17/12*** | (2006.01) |
| ***F21V 17/18*** | (2006.01) |
| ***F21L 4/02*** | (2006.01) |
| ***F21V 17/02*** | (2006.01) |

(Continued)

(52) U.S. Cl.

CPC *F21L 4/04* (2013.01); *F21L 4/02* (2013.01); *F21V 17/02* (2013.01); *F21V 17/12* (2013.01); *F21V 17/162* (2013.01); *F21V 17/18* (2013.01); *F21V 21/145* (2013.01); *F21V 21/30* (2013.01); *F21V 21/34* (2013.01); *F21L 2001/00* (2013.01); *F21V 31/005* (2013.01); *F21Y 2105/10* (2016.08); *F21Y 2115/10* (2016.08)

(58) Field of Classification Search

CPC .... F21L 4/04; F21L 4/02; F21V 21/30; F21V 21/145; F21V 21/34; F21V 17/162; F21V 17/02; F21V 17/12; F21V 17/18

See application file for complete search history.

(56) References Cited

U.S. PATENT DOCUMENTS

| | | | | |
|---|---|---|---|---|
| 9,316,384 | B2 * | 4/2016 | Mumma | F21L 14/00 |
| 2016/0298831 | A1 * | 10/2016 | Fang | F21V 21/06 |

* cited by examiner

*Primary Examiner* — David V Bruce

(57) ABSTRACT

Disclosed is a portable LED light, which includes symmetrical LED light housings, rotating members fixedly connected with the housings, symmetrical handle members, a first rotation shaft, a support device and outer gears fixed on an end of the rotating members. The support device is provided for supporting the handle members and the LED light housings. The rotating members and the base bodies disposed inside the handle members are provided for adjusting an angle between the two LED light housings. It has advantages that the angle between the LED light housings can be adjusted at pleasure and LED light housings can be supported by the support device steadily. The present invention further has the advantages of small size, easy to carry, easy to operate and steady fixation.

10 Claims, 11 Drawing Sheets

(51) Int. Cl.

| | |
|---|---|
| ***F21V 17/16*** | (2006.01) |
| ***F21V 21/14*** | (2006.01) |
| ***F21V 21/34*** | (2006.01) |
| ***F21V 21/30*** | (2006.01) |
| *F21Y 115/10* | (2016.01) |
| *F21V 1/00* | (2006.01) |
| *F21V 31/00* | (2006.01) |
| *F21Y 105/10* | (2016.01) |

PORTABLE LED LIGHT

FIELD OF THE INVENTION

The present invention relates to LED light, and more particularly to a portable LED light.

BACKGROUND OF THE INVENTION

LED lights have been widely used in people's daily life due to the advantages of long service life, high efficiency, energy saving and safe. And the portable LED lights are generally used for outdoor lighting or charging external devices and so on due to the advantages of small size and easy to carry. However, the existing portable LED lights have some disadvantages as follows: after being fixed to a holder, the portable LED light is hard to be adjusted freely, and even its angle can be adjusted, it is hard to be fixed at a certain angle after being adjusted. Additionally, when the portable LED light is used in wild, there is needed to provide a fixed support for supporting the portable LED light, however, the existing fixed support is generally too big to carry around or cannot provide a steady support.

In view of the above problems, the inventor has designed a portable LED light which includes an angle adjusting device to adjust the angle of the LED light and has a support device to support the LED light.

SUMMARY OF THE INVENTION

An object of the present invention is to provide a portable LED light so as to overcome the defects of the prior art.

To achieve above object, there is provided a technical solution as follows:

A portable LED light includes symmetrical LED light housings, rotating members fixedly connected with the housings, symmetrical handle members, a first rotation shaft, a support device and outer gears fixed on an end of the rotating members; an end of the handle member is rotatably connected with the housing via the rotating members; two pairs of guide rods are fixed on a bottom of an inner wall of the handle members, each pair of the guide rods comprising two guide rods and each guide rod having a circular stopper formed thereon and close to an outer end of the guide rod; the handle member is provided with a base body therein, each of two sides of the base body having an upper guide hole and a lower guide hole formed thereon, both of which are able to slide up and down along the guide rod, and bore diameter of the upper guide hole being larger than that of the lower guide hole and smaller than a diameter of the circular stopper; the guide rod is sleeved with a first compression spring which is located into the upper guide hole, the base body being able to slide up and down along the guide rod under an action of external force; and the base body has a cavity formed at center thereof for accommodating the outer gear, a gear tooth being provided on a top of an inner wall of the cavity for fitting the outer gear, and a sum of whole depth of the gear tooth and outside radius of the outer gear being smaller than a radius of the cavity; after the symmetrical handle members are assembled together, an axle hole is formed on an end of the handle members where is far from the LED light housings; and one end of the first rotation shaft passes through the axle hole and connects with the handle members fixedly and the other end of the first rotation shaft passes through the axle hole and connects with an end of the support device rotatably.

In a preferred embodiment, the support device comprises a rotary knob, a fixed base for supporting the LED light housings, a connecting member provided between the rotary knob and the fixed base and at least three support members; an end of the fixed base where is far from the rotary knob is hinged with the first rotation shaft via a hinge shaft, a locking assembly is provided on the end of the fixed base where is far from the rotary knob for locking the first rotation shaft and the fixed base; the rotary knob comprises a rotating head, a rotating tail and a limiting ring provided between the rotating head and the rotating tail, the rotating tail being provided with rotating bumps formed on an outer wall thereof, the number of the bumps being equal to the number of the support members, the rotating bump having a height increasing gradually along a circumference of the rotating tail, and the rotating tail being provided with a plurality of circular grooves formed along the circumference of the rotating tail; the fixed base is fixedly connected with the connecting member via screws which pass through the circular grooves of the rotary knob so that the rotary knob is able to rotate relative to the fixed base; the connecting member comprises a body part, the body part having a cavity and being provided with lugs arranged on outside surface of an end of the body part, the number of the lugs being equal to the number of the support members; the lug is provided with a through-hole formed along a radial direction of the body part and a first lock-pin is provided in the through-hole, a radius of the cavity of the body part being smaller than that of the limiting ring and larger than a distance from the rotating bump to an axis of the rotary knob; and the support member is provided with a round-hole formed on an end thereof and along a longitudinal direction thereof and a second lock-pin is provided in the round-hole, the second lock-pin being sleeved with a second compression spring which is provided in the round-hole, the end of the support member on which the round-hole is formed being hinged with the lug and the round-hole and the though-hole being arranged on the same plane.

In a preferred embodiment, the locking assembly comprises a rotating handle which has a bump formed on an end thereof, a pressing part, a first pressing plate and a second pressing plate; the hinge shaft is connected with the rotating handle via a bolt after passing through an axle hole formed on an end of the fixed base, the first rotation shaft, the first pressing plate, the second pressing plate, another axle hole formed the end of the fixed base and the pressing part in sequence; the first pressing plate is fixedly connected with the first rotation shaft and the second pressing plate is fixedly connected with an inner surface of the end of the fixed base; and the first pressing plate is provided with a first sawtooth portion formed on a side thereof, the second pressing plate is provided with a second sawtooth portion formed on a side thereof for engaging with the first sawtooth portion, and when rotating the rotating handle, the bump of the rotating handle is able to gradually compress the first pressing plate and the second pressing plate tightly via the pressing part.

In a preferred embodiment, the lug is provided with a sliding slot formed on an outer wall thereof, all of the sliding slot, the round-hole and the through-hole being arranged on the same plane so that the second lock-pin is able to slide in or slide out of the through-hole along the sliding slot.

In a preferred embodiment, there are a fixed board, a circuit board fixed on the fixed board and a light cover covering the circuit board, all of which are arranged inside the LED light housing in sequence; and there are layers of waterproof circular members provided between an edge of the light cover and an edge of the LED light housing.

In a preferred embodiment, there is a casing pipe provided in the round-hole, the second lock-pin and the second compression spring being arranged in the casing pipe.

In a preferred embodiment, the fixed base is sleeved with a fixing member for fixing the support members.

In a preferred embodiment, the number of the support members is three.

In a preferred embodiment, the support member is provided with a support leg fixed on an end thereof where is far from the lug.

In a preferred embodiment, a first waterproof ring is provided between the rotating member and the LED light housing; and a second waterproof ring is provided between the rotating member and the handle member.

According to the above technical solutions, the present invention has following beneficial effects: under the action of the first compression spring, the base body will be pressed towards the bottom of the handle member by the first compression spring, the outer gear will engage with the gear tooth provided in the cavity so that the LED light housings keep a certain angle with each other; if the housing rotates under the action of external force, the rotating member and the outer gear will rotate driven by the housing, the outer gear will act on the gear tooth provided in the cavity, the gear tooth will in turn drive the base body move up and then the gear tooth in the cavity will engage with the next tooth of the outer gear, at the same time, the base body will be pressed towards the bottom of the handle member by the first compression spring, thereby the LED light housings will be fixed at another certain angle therebetween. By this, the angle between the two LED light housings could be adjusted and also could be fixed after being adjusted. The support device can support the LED light housings and the handle members steadily; when the LED light is needed to be supported, the LED light can be fixed on the support device by the locking assembly and at the same time, the support members can be unfolded; under the action of the second compression spring, the second lock-pin will enter into the through-hole along the direction of round-hole so as to fixedly connect the support member and the connecting member, thereby avoiding the support member to rotate relative to the fixed base and achieving a fixed connection between the support member and the fixed base; and when the support members are needed to be folded, rotate the rotary knob and then the first lock-pin will be pushed by the rotating bump in turn to push the second lock-pin provided in the through-hole, thus the support member can be folded after the second lock-pin leaves the through-hole; additionally, the sliding slot plays a guiding role so that the second lock-pin is easy to slide in or slide out of the through-hole. The present invention further has the advantages of small size, easy to carry, easy to operate and steady fixation.

Other aspects, features, and advantages of the present invention will become apparent from the following detailed description when taken in conjunction with the preferred embodiment and the accompanying drawings, which are a part of this disclosure and which illustrate, by way of example, principles of the present invention.

DETAILED DESCRIPTION OF ILLUSTRATED EMBODIMENTS

Some embodiments of the present invention will be described as follows, by way of example only, with reference to the accompanying drawings. And it should be noted that the features of different embodiments could be combined if there is no conflicts.

Figure 1:
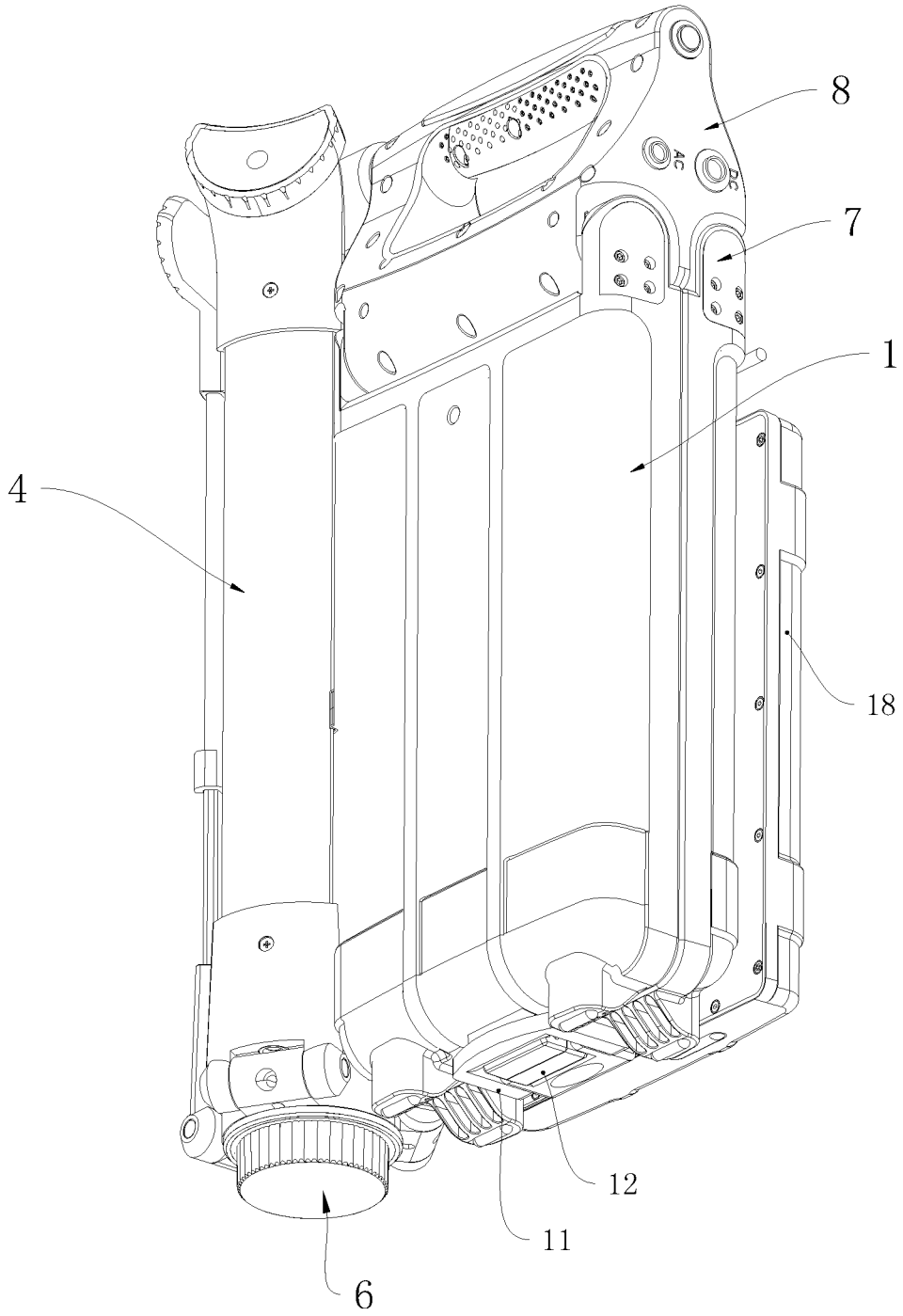
FIG. 1 illustrates an external structure of the present invention.
Figure 2:
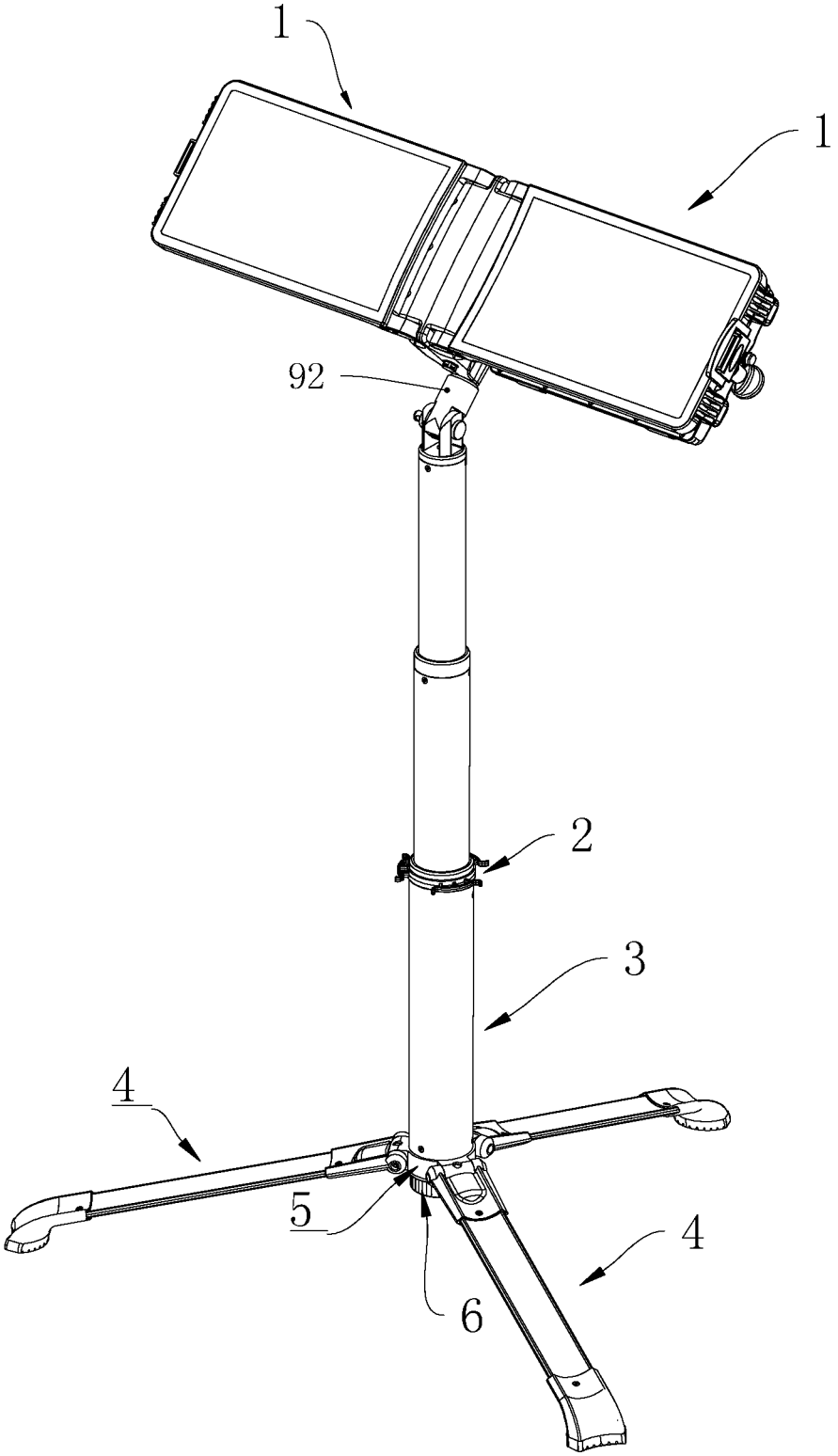
FIG. 2 illustrates the LED light being supported by the support device according to the present invention.
Figure 3:
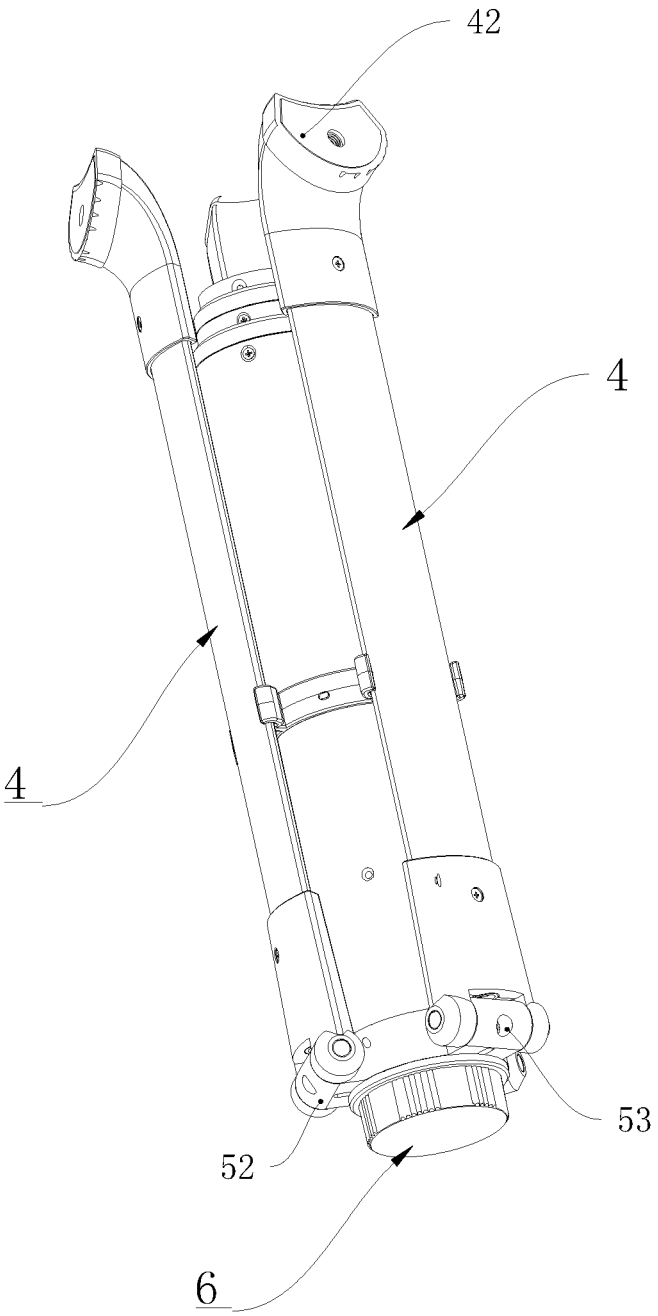
FIG. 3 illustrates the support device according to the present invention.
Figure 4:
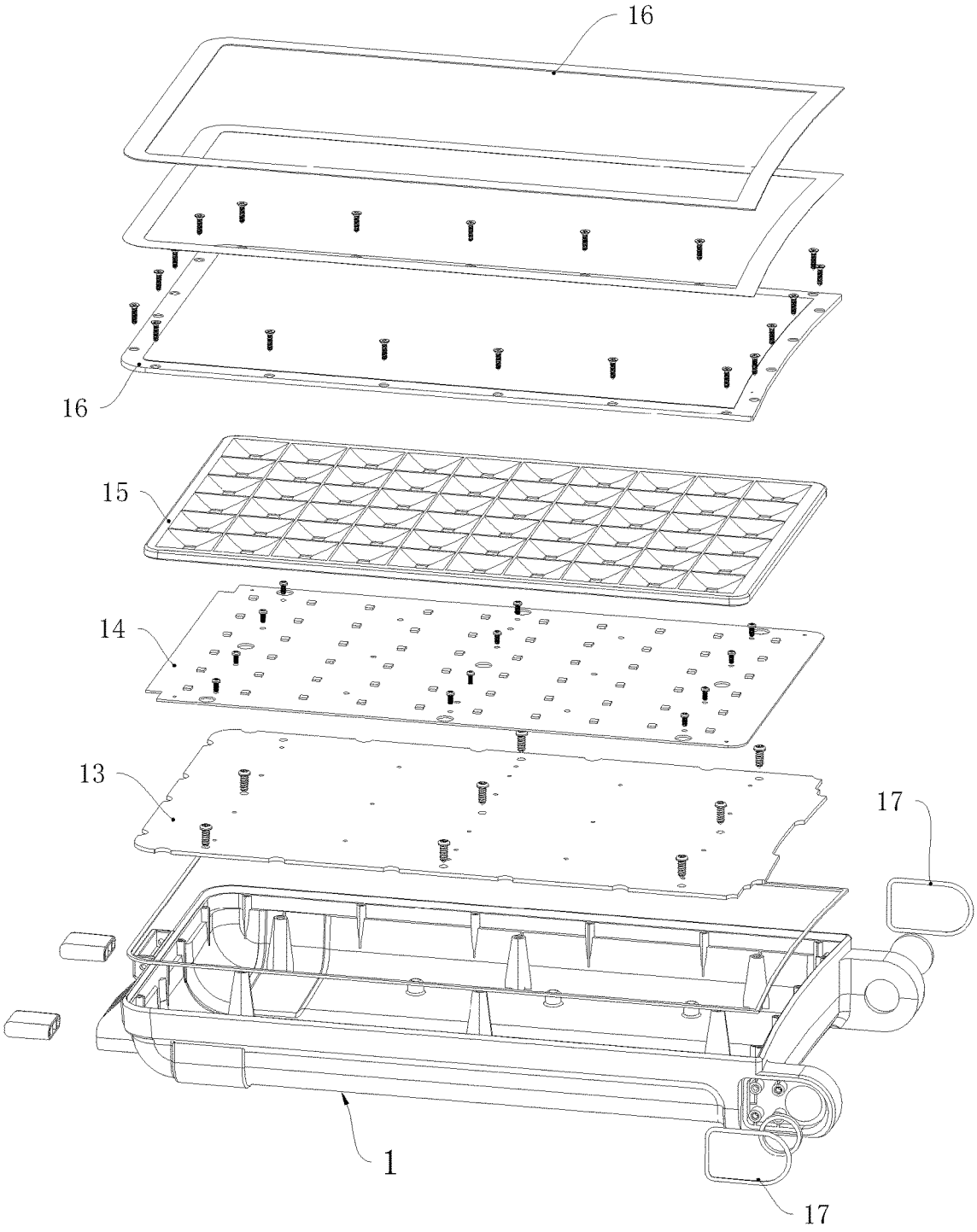
FIG. 4 illustrates an inner structure of the LED light housing according to the present invention.
Figure 5:
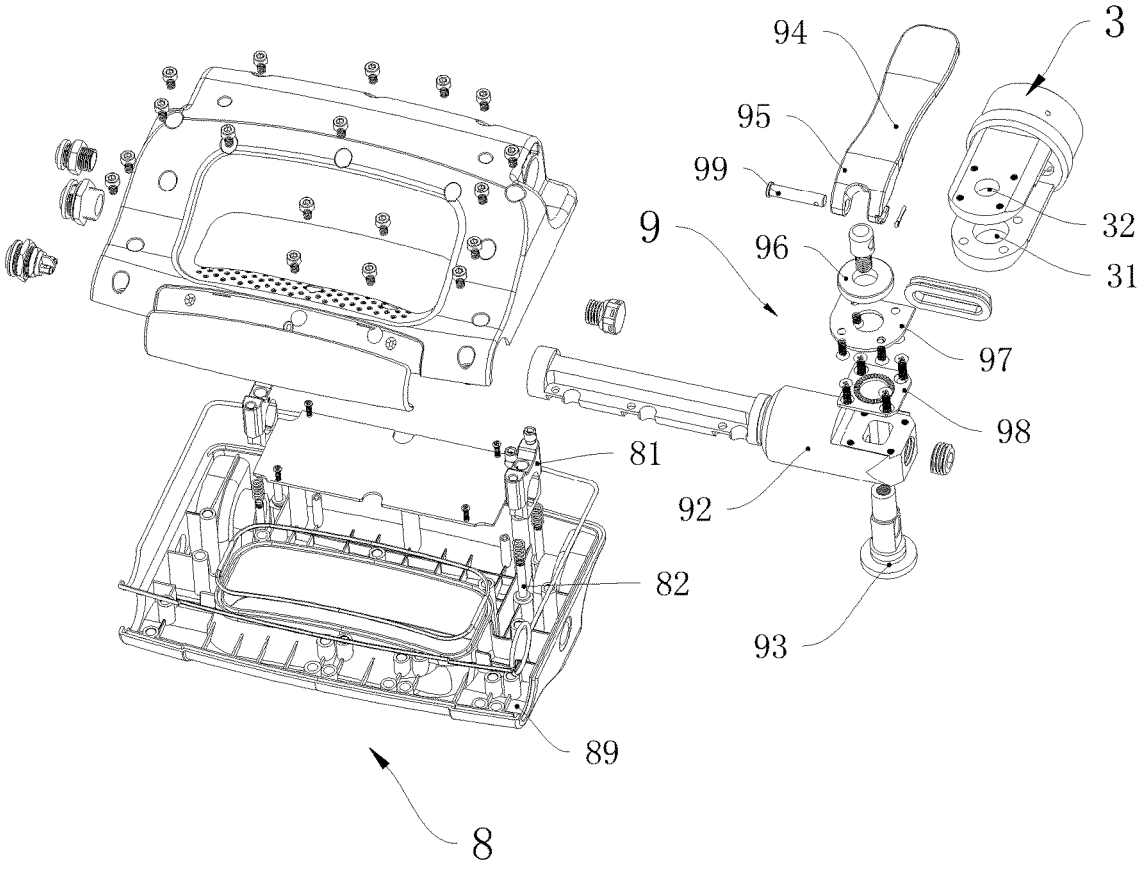
FIG. 5 is an exploded view of the handle member and the locking assembly according to the present invention.
Figure 6:
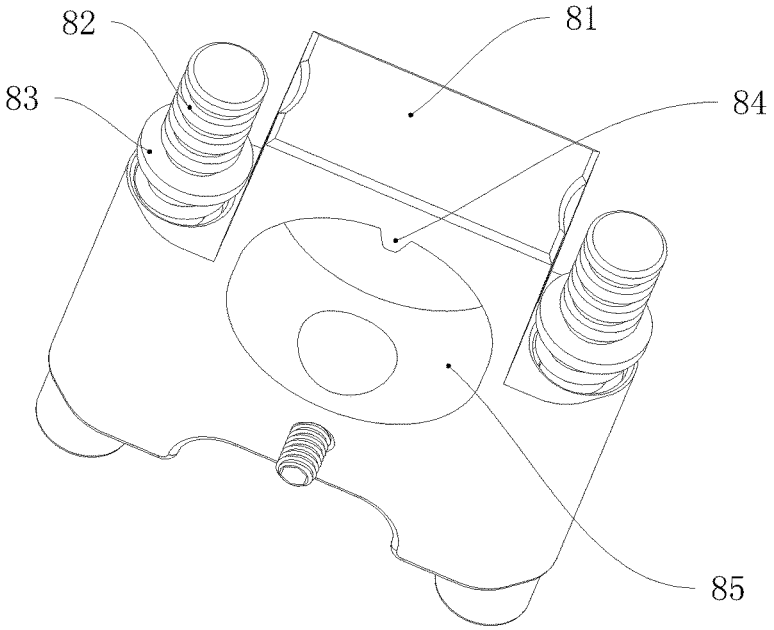
FIG. 6 illustrates the base body according to the present invention.
Figure 7:
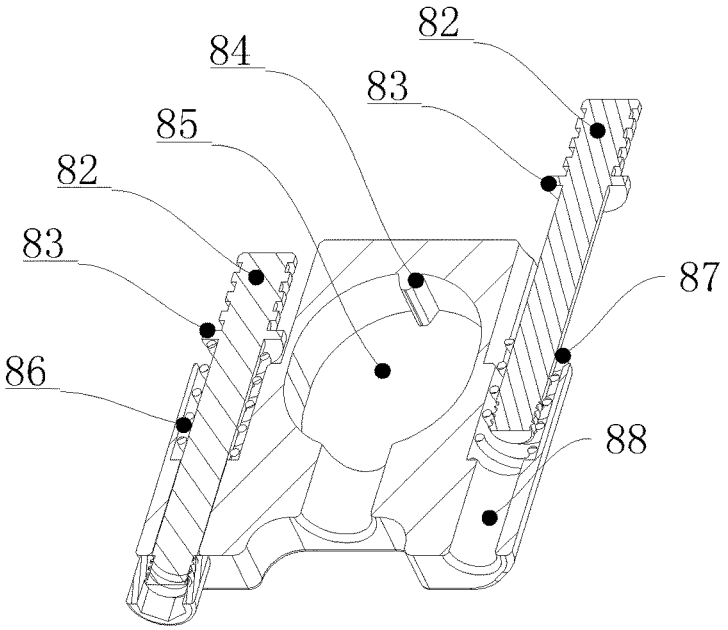
FIG. 7 is a section view of FIG. 6.
Figure 8:
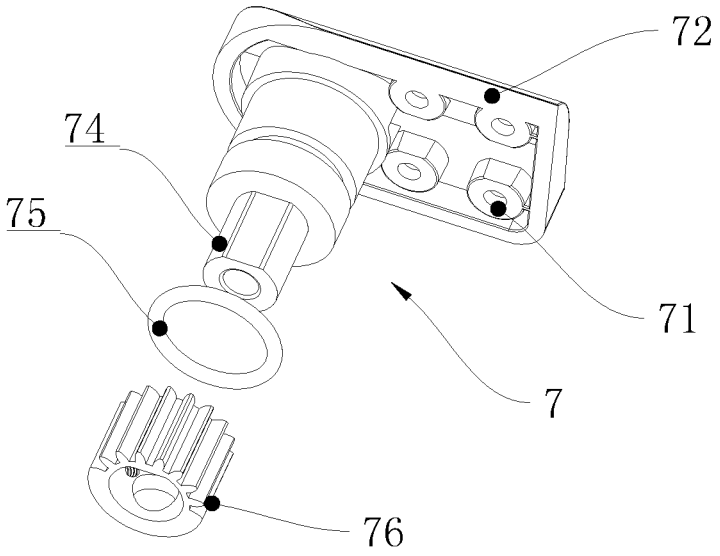
FIG. 8 illustrates the first rotation shaft and the outer gear according to the present invention.
Figure 9:
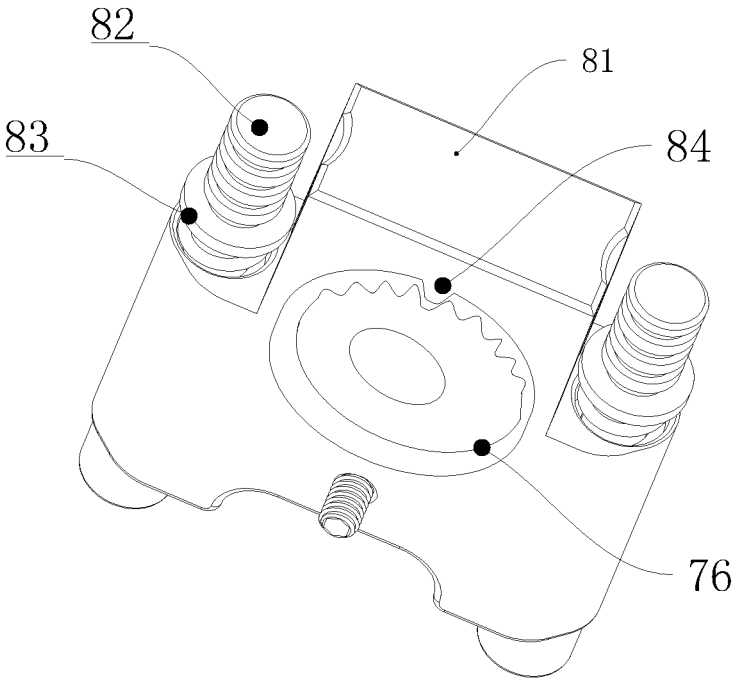
FIG. 9 illustrates the base body engaging with the outer gear according to the present invention.
Figure 10:
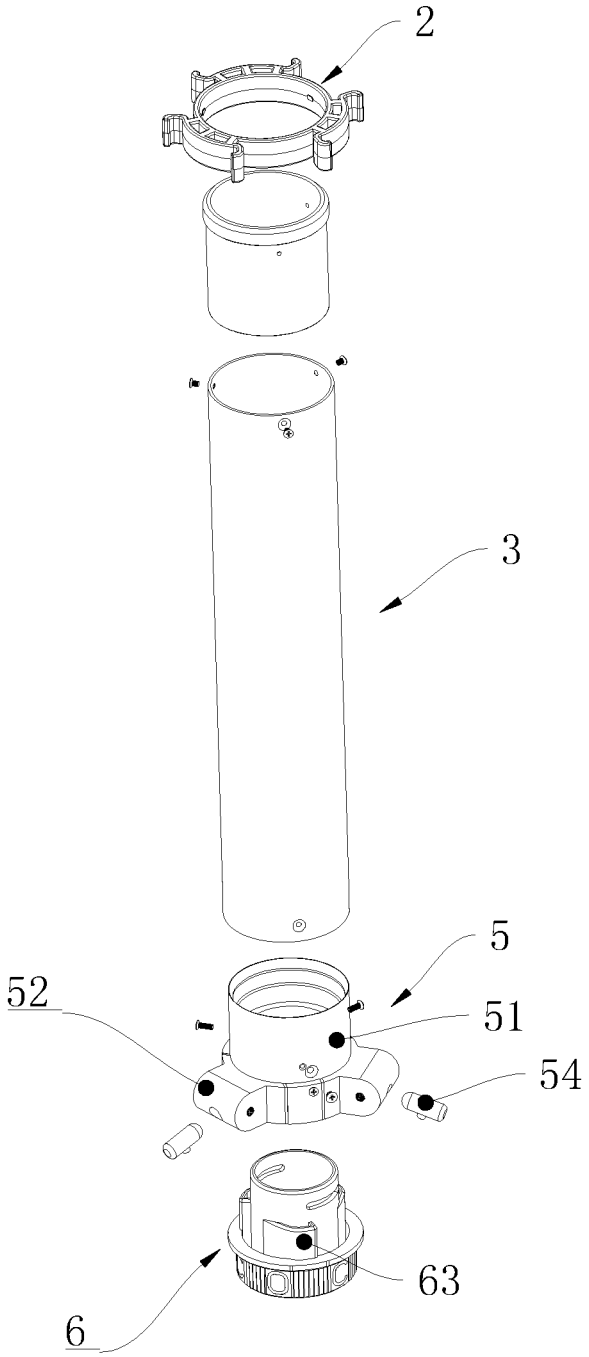
FIG. 10 is an exploded view of the support device after removing the support members according to the present invention.
Figure 11:
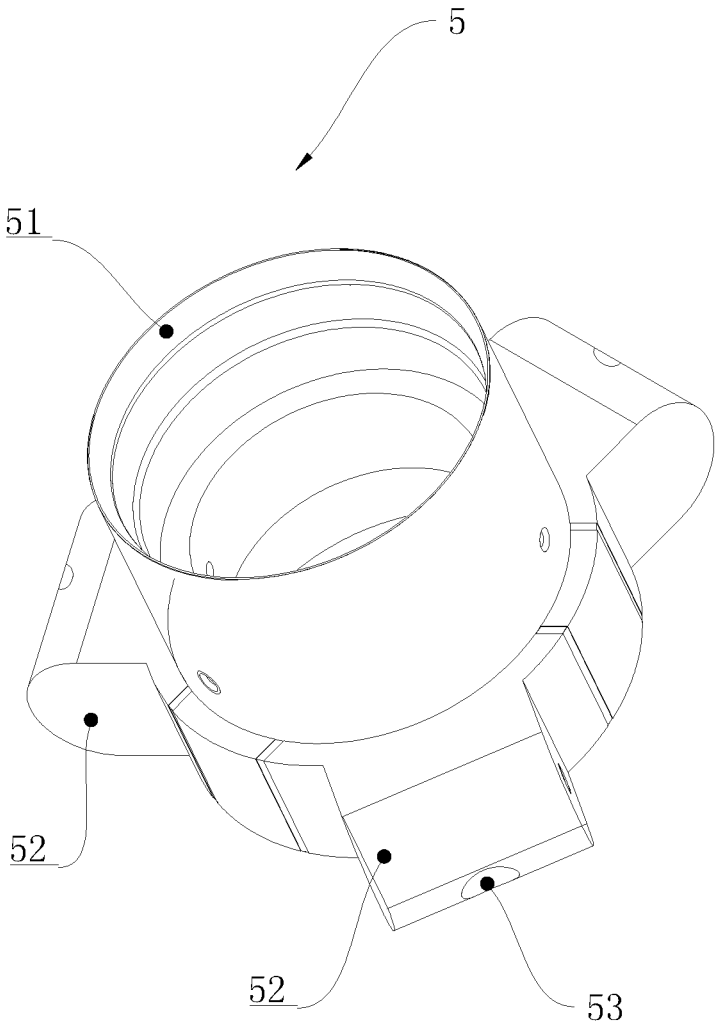
FIG. 11 is a perspective view of the connecting member according to the present invention.
Figure 12:
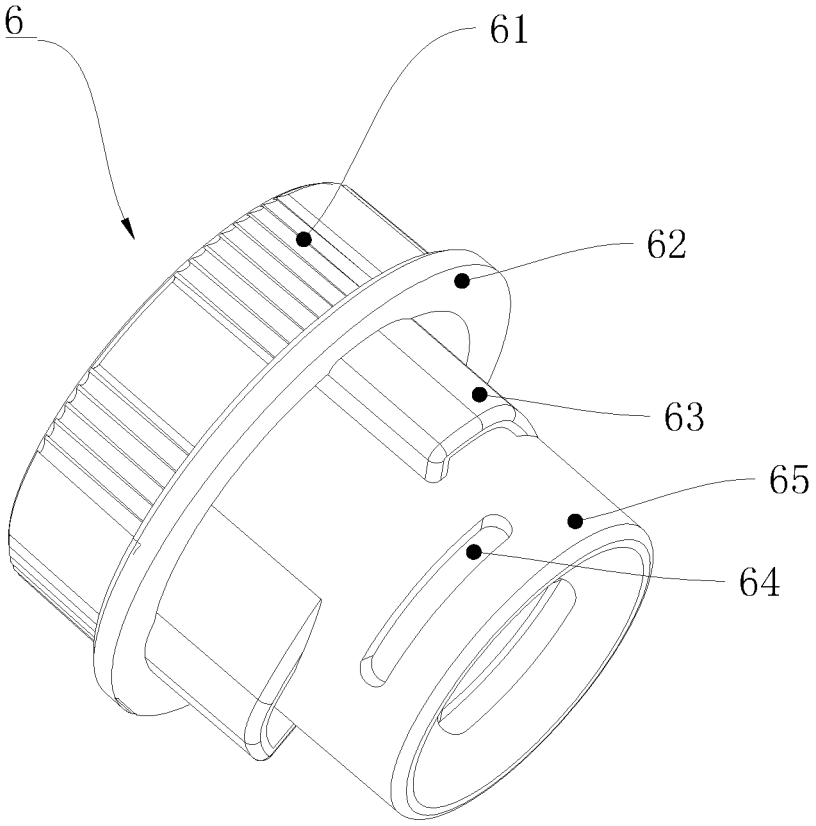
FIG. 12 is a perspective view of the rotary knob according to the present invention.
Figure 13:
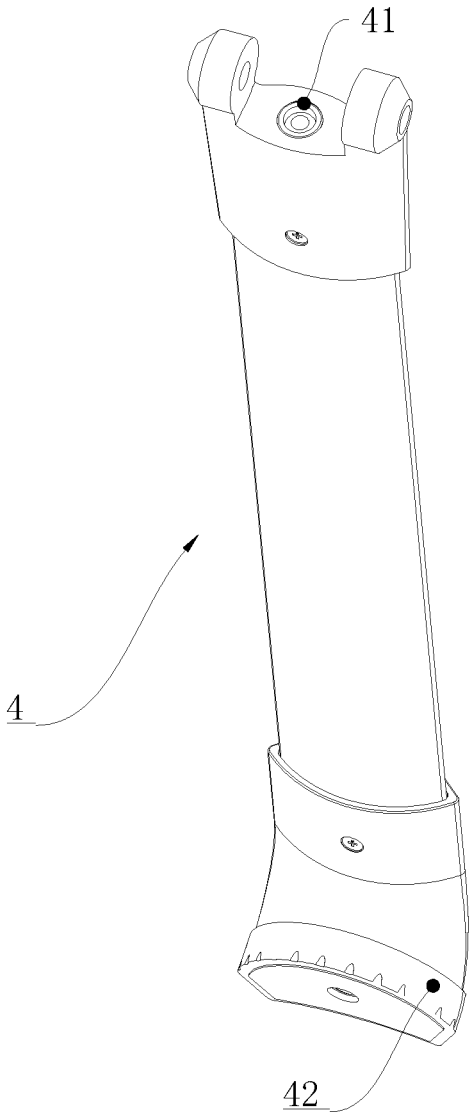
FIG. 13 illustrates the support member according to the present invention.

As shown from FIG.1 to FIG. 13, a portable LED light includes two symmetrical LED light housings 1, rotating members 7 fixedly connected with the housings 1, two symmetrical handle members 8, a first rotatable shaft 92, a support device and outer gears 76 fixed on an end of the rotating members 7.

There is a battery 18 provided on an outer side of the LED light housings 1. There are a fixed board 13, a circuit board 14 fixed on the fixed board 13 and a light cover 15 covering the circuit board 14, all of which are arranged inside the LED light housing 1 in sequence. The circuit board 14 is provided with LED sources, the battery 18 is provided for supplying power to the LED sources, and the light emitted by the LED sources will diffuse into outside world by passing through the light cover 15. There are layers of waterproof circular members provided between an edge of the light cover 14 and an edge of the LED light housing 1.

The rotating member 7 includes a second rotation shaft 74 and a connecting piece 72 extending from the rotating member 7 along a radial direction. The connecting piece 72 is provided with threaded holes 71 formed thereon and the connecting piece 72 is fixedly connected with the housing 1 with screws. The outer gear 76 is fixed to an end of the second rotation shaft 74, and specifically, the outer gear 76 has an axle hole formed thereon and the outer gear 76 is mounted on the second rotation shaft 74. The outer gear 76 has several threaded holes formed thereon in a radial direction thereof, the second rotation shaft 74 also has several threaded holes formed thereon, and then the outer gear 76 could be fixedly connected with the second rotation shaft 74 via screws; in another embodiment, the outer gear 76 has a keyway formed on the axle hole in an axial direction thereof, the second rotation shaft 74 also has a keyway formed thereon, and then the outer gear 76 could be fixedly connected with the second rotation shaft 74 via a key. Furthermore, there is a first waterproof ring 17 provided between the second rotation shaft 74 and the housing 1 so as to prevent the water vapor from entering into of the LED light housing 1.

An end of the handle member 8 is rotatably connected with the LED light housing 1 via the rotating members 7. One of the housings 1 has a locking element 11 provided on a side thereof and opposite to the handle member 8; and the other one of the housings 1 has a groove 12 formed thereon for fitting the locking element 11. The two housings 1 could be locked together by means of the cooperation of the locking element 11 and the groove 12. There is a second waterproof ring 75 provided between the rotating member 7 and the handle member 8 so as to prevent the water vapor from entering into of the LED light housing 1. The handle member 8 is able to rotate relative to the LED light housing 1. Two pairs of guide rods 82 are fixed on a bottom of an inner wall of the handle member 8, each pair of the guide rods including two guide rods 82 and each guide rod 82 having a circular stopper 83 formed thereon and close to an outer end of the guide rod 82. After the symmetrical handle members 8 are assembled together, an axle hole 89 is formed on an end of the handle members 8 where is far from the LED light housings 1; and one end of the first rotation shaft 92 passes through the axle hole 89 and connects with the handle members 8 fixedly and the other end of the first rotation shaft 92 passes through the axle hole 89 and connects with an end of the support device rotatably.

It further includes base bodies 81, and each of two sides of the base body 81 has an upper guide hole 87 and a lower guide hole 88 formed thereon, both of which are capable of sliding up and down along the guide rod 82. The bore diameter of the upper guide hole 87 is larger than that of the lower guide hole 88 and smaller than a diameter of the circular stopper 83. The guide rod 82 is sleeved with a first compression spring 86 which is located into the upper guide hole 87 and presses the base body 81 towards the bottom of the inner wall of the handle member 8, the base body 81 being capable of sliding up and down along the guide rod 82 under the action of external force. The base body 81 further has a cavity 85 formed at center thereof for accommodating the outer gear 76, and a gear tooth 84 is provided on a top of an inner wall of the cavity 85 for fitting the outer gear 76. The sum of whole depth of the gear tooth 84 and outside radius of the outer gear 76 is smaller than a radius of the cavity 85. The gear tooth 84 is able to move up and down in the cavity 85 under the action of external force. In this embodiment, in order to reduce processing cost, only half of the periphery of the outer gear 76 is provided with teeth.

The support device includes a rotary knob 6, a fixed base 3 for supporting the LED light housings 1, a connecting member 5 provided between the rotary knob 6 and the fixed base 3 and at least three support members 4; and an end of the fixed base 3 where is far from the rotary knob 6 is hinged with the first rotation shaft 92 via a hinge shaft 93. There is a locking assembly 9 provided on the end of the fixed base 3 where is far from the rotary knob 6 for locking the first rotation shaft 92 and the fixed base 3. The locking assembly 9 includes a rotating handle 94 which has a bump 95 formed on an end thereof, a pressing part 96, a first pressing plate 98 and a second pressing plate 97. The hinge shaft 93 is connected with the rotating handle 94 via a bolt 99 after passing through an axle hole 31 formed on an end of the fixed base 3, the first rotation shaft 92, the first pressing plate 98, the second pressing plate 97, another axle hole 32 formed the end of the fixed base 3 and the pressing part 96 in sequence. The first pressing plate 98 is fixedly connected with the first rotation shaft 92 and the second pressing plate 97 is fixedly connected with an inner surface of the end of the fixed base 3. The first pressing plate 98 is provided with a first sawtooth portion formed on a side thereof, the second pressing plate 97 is provided with a second sawtooth portion formed on a side thereof for engaging with the first sawtooth portion. When rotating the rotating handle 94, the bump 95 of the rotating handle 94 is able to gradually compress the first pressing plate 98 and the second pressing plate 97 tightly via the pressing part 96 until the fixed base 3 is locked with the first rotation shaft 92.

The connecting member 5 includes a body part 51 which has a cavity and is provided with lugs 52 arranged on outside surface of an end of the body part 51, the number of the lugs 52 being equal to the number of the support members 4. The lug 52 is provided with a through-hole 53 formed along a radial direction of the body part 51 and a first lock-pin 54 is provided in the through-hole 53, a radius of the cavity of the body part 51 being smaller than that of the limiting ring 62 and larger than a distance from the rotating bump 63 to an axis of the rotary knob 6. The rotary knob 6 is arranged in the cavity of the connecting member 5, wherein the rotating head 61 is disposed outside the cavity of the connecting member 5 and the rotating tail 65 is disposed inside the cavity of the connecting member 5. The limiting ring 62 is supported by the connecting member 5 and the rotating tail 65 is able to rotate freely in the cavity of the connecting member 5. During the rotating tail 65 rotating in the cavity of the connecting member 5, the bump 63 will drive the first lock-pin 54 to move back and forth along the through-hole 53. The fixed base 3 is fixedly connected with the connecting member 5 via screws which pass through the circular grooves 64 of the rotary knob 6 so that the rotary knob 6 is able to rotate relative to the fixed base 3. The screws can avoid the rotary knob 6 to get away from the connecting member 5 and the screws are able to slide along the circular grooves 64.

The rotary knob 6 includes a rotating head 61, a rotating tail 65 and a limiting ring 62 provided between the rotating head 61 and the rotating tail 65, the rotating tail 65 being provided with rotating bumps 63 formed on an outer wall thereof. The number of the bumps 63 is equal to the number of the support members 4, the rotating bump 63 has a height increasing gradually along a circumference of the rotating tail 65, the section of the rotating bump 63 is an asymptotic line and a distance between a peak of the rotating bump 63 and an axes of the rotating tail 65 is smaller than the radius of the rotating head 61. The rotating tail 65 is provided with a plurality of circular grooves arranged along the circumference of the rotating tail 65. The circular grooves are arranged between the end of the rotating tail 65 and the rotating bump 63. The fixed base 3 is fixedly connected with the connecting member 5 via screws which pass through the circular grooves 64 of the rotary knob 6 so that the rotary knob 6 is able to rotate relative to the fixed base 3. The number of the circular grooves could be two, three or four, and in this embodiment, the number of the circular grooves is two.

The support member 4 is provided with a round-hole 41 formed on an end thereof and along a longitudinal direction thereof and a second lock-pin is provided in the round-hole 41, the second lock-pin being sleeved with a second compression spring which is provided in the round-hole 41. The end of the support member 4 on which the round-hole 41 is formed is hinged with the lug 52; and the round-hole 41 and the though-hole 53 are arranged on the same plane. There is a casing pipe provided in the round-hole 41, the second lock-pin and the second compression spring being arranged in the casing pipe. The fixed base 3 is sleeved with a fixing member 2 for fixing the support members 4. The number of the support members 4 is three. The support member 4 is provided with a support leg 42 fixed on an end thereof where is far from the lug 52. In order to achieve the objective of the present invention better, there is a casing pipe provided in the round-hole 41, the second lock-pin and the second compression spring being arranged in the casing pipe. The fixed base 3 is sleeved with a fixing member 2 for fixing the support members 4. The number of the support members 4 is three. When the support device of the portable LED light is folded, the support members are fixed by the fixing member 2. The support member 4 is provided with a support leg 42 fixed on an end thereof where is far from the lug 52. The support leg 42 is provided to increase contact area with the ground so that the support device of the portable LED light can support the LED light more stably.

The usage of the present invention is as follows: firstly unfold the support device, and then rotate the handle member 8 and the support device and then lock them tightly, and finally adjust the angle between the two symmetrical LED light housings 1.

The specific operation is as follows:

Unfold the support device. The rotary knob 6 is located in the connecting member 5. The fixed base 3 is fixedly connected with the connecting member 5 via screws which pass through the circular grooves 64 of the rotary knob 6 so that the rotary knob 6 is able to rotate relative to the connecting member 5 along the fixed base 3. When need to unfold the support device, firstly rotate the rotary knob 6 in a direction, the bump 63 will not push the first lock-pin 54 and the first lock-pin 54 will move towards the inside of the through-hole 53; then rotate the support members, the second lock-pin will slide into the through-hole 53 under the action of the second compression spring, at this time both of the support members 4 and the fixed base 3 are unfolded. The second lock-pin is provided to prevent the support members 4 from rotating relative to the fixed base 3. When need to fold the support device, rotate the rotary knob 6 in an opposite direction, the bump 63 of the rotary knob 6 will push the first lock-pin 54 to move towards the outside of the through-hole 53, and then the first lock-pin 54 will push the second lock-pin to leave the through-hole 53 so that the support members can be folded.

Rotate the handle member 8 and the support device and then lock them tightly. Rotate the first rotation shaft 92 and the fixed base 3 to be a certain angle and then rotate the rotating handle 94. When rotating the rotating handle 94, the bump 95 of the rotating handle 94 is able to gradually compress the first pressing plate 98 and the second pressing plate 97 tightly via the pressing part 96, at this time, the first sawtooth portion of the first pressing plate 98 is engaging with the second sawtooth portion of the second pressing plate 97, thereby the fixed base 3 of the support device is locked with the first rotation shaft 92.

Adjust the angle between the two symmetrical LED light housings 1. When a certain angle is formed between the two symmetrical housings 1, one of the teeth of the outer gear 76 engages with the gear tooth 84 so as to produce engaging force, at the same time, the base body 81 is pressed towards the bottom of the handle member 8 by the first compression spring 86 so as to availably prevent the gear tooth 84 from rotating relative to the outer gear 76, thereby allowing the two symmetrical housings 1 to be fixed at a certain angle. When need to adjust the angle between the two housings 1, rotate the LED light housing 1, the second rotation shaft 72 will be driven to rotate by the housing 1,and then the outer gear 76 will push the base body 81 to move in a direction away from the bottom of the handle member 8. When the base body 81 moves up through a distance, the tooth of the outer gear 76 which is engaging with the gear tooth 84 will pass over the gear tooth 84 and then the next tooth of the outer gear 76 will engage with the gear tooth 84, at the same time the base body 81 will be pressed towards the bottom of the handle member 8 by the first compression spring 86 so as to availably prevent the gear tooth 84 from rotating relative to the outer gear 76, thereby allowing the two symmetrical housings 1 to be fixed at another angle.

In some embodiments, the lug 52 is provided with a sliding slot formed on an outer wall thereof, all of the sliding slot, the round-hole 41 and the through-hole 53 being arranged on the same plane so that the second lock-pin is able to slide in or slide out of the through-hole along the sliding slot.

Above descriptions of embodiments are provided for further illustrating the technical content of the present invention, so as to facilitate understanding and it should be understood that the invention is not to be limited to the disclosed embodiments. Any technique extension and recreation according to the present invention should be included within the scope of protection of the invention.

What is claimed is:

1. A portable LED light, comprising symmetrical LED light housings, rotating members fixedly connected with the housings, symmetrical handle members, a first rotation shaft, a support device and outer gears fixed on an end of the rotating members, wherein an end of the handle member is rotatably connected with the housing via the rotating members; two pairs of guide rods are fixed on a bottom of an inner wall of the handle members, each pair of the guide rods comprising two guide rods and each guide rod having a circular stopper formed thereon and close to an outer end of the guide rod; the handle member is provided with a base body therein, each of two sides of the base body having an upper guide hole and a lower guide hole formed thereon, both of which are able to slide up and down along the guide rod, and bore diameter of the upper guide hole being larger than that of the lower guide hole and smaller than a diameter of the circular stopper; the guide rod is sleeved with a first compression spring which is located into the upper guide hole, the base body being able to slide up and down along the guide rod under an action of external force; and the base body has a cavity formed at center thereof for accommodating the outer gear, a gear tooth being provided on a top of an inner wall of the cavity for fitting the outer gear, and a sum of whole depth of the gear tooth and outside radius of the outer gear being smaller than a radius of the cavity;

after the symmetrical handle members are assembled together, an axle hole is formed on an end of the handle members where is far from the the LED light housings; and one end of the first rotation shaft passes through the axle hole and connects with the handle members fixedly and the other end of the first rotation shaft passes through the axle hole and connects with an end of the support device rotatably.

2. The portable LED light according to claim 1, wherein the support device comprises a rotary knob, a fixed base for supporting the LED light housings, a connecting member provided between the rotary knob and the fixed base and at least three support members; an end of the fixed base where is far from the rotary knob is hinged with the first rotation shaft via a hinge shaft, a locking assembly is provided on the end of the fixed base where is far from the rotary knob for locking the first rotation shaft and the fixed base; the rotary knob comprises a rotating head, a rotating tail and a limiting ring provided between the rotating head and the rotating tail, the rotating tail being provided with rotating bumps formed on an outer wall thereof, the number of the bumps being equal to the number of the support members, the rotating bump having a height increasing gradually along a circumference of the rotating tail, and the rotating tail being provided with a plurality of circular grooves formed along the circumference of the rotating tail; the fixed base is fixedly connected with the connecting member via screws which pass through the circular grooves of the rotary knob so that the rotary knob is able to rotate relative to the fixed base; the connecting member comprises a body part, the body part having a cavity and being provided with lugs arranged on outside surface of an end of the body part, the number of the lugs being equal to the number of the support members; the lug is provided with a through-hole formed along a radial direction of the body part and a first lock-pin is provided in the through-hole, a radius of the cavity of the body part being smaller than that of the limiting ring and larger than a distance from the rotating bump to an axis of the rotary knob; and the support member is provided with a round-hole formed on an end thereof and along a longitudinal direction thereof and a second lock-pin is provided in the round-hole, the second lock-pin being sleeved with a second compression spring which is provided in the round-hole, the end of the support member on which the round-hole is formed being hinged with the lug and the round-hole and the though-hole being arranged on the same plane.

3. The portable LED light according to claim 2, wherein the locking assembly comprises a rotating handle which has a bump formed on an end thereof, a pressing part, a first pressing plate and a second pressing plate; the hinge shaft is connected with the rotating handle via a bolt after passing through an axle hole formed on an end of the fixed base, the first rotation shaft, the first pressing plate, the second pressing plate, another axle hole formed the end of the fixed base and the pressing part in sequence; the first pressing plate is fixedly connected with the first rotation shaft and the second pressing plate is fixedly connected with an inner surface of the end of the fixed base; and the first pressing plate is provided with a first sawtooth portion formed on a side thereof, the second pressing plate is provided with a second sawtooth portion formed on a side thereof for engaging with the first sawtooth portion, and when rotating the rotating handle, the bump of the rotating handle is able to gradually compress the first pressing plate and the second pressing plate tightly via the pressing part.

4. The portable LED light according to claim 2, wherein the lug is provided with a sliding slot formed on an outer wall thereof, all of the sliding slot, the round-hole and the through-hole being arranged on the same plane so that the second lock-pin is able to slide in or slide out of the through-hole along the sliding slot.

5. The portable LED light according to claim 1, wherein there are a fixed board, a circuit board fixed on the fixed board and a light cover covering the circuit board, all of which are arranged inside the LED light housing in sequence; and there are layers of waterproof circular members provided between an edge of the light cover and an edge of the LED light housing.

6. The portable LED light according to claim 2, wherein there is a casing pipe provided in the round-hole, the second lock-pin and the second compression spring being arranged in the casing pipe.

7. The portable LED light according to claim 2, wherein the fixed base is sleeved with a fixing member for fixing the support members.

8. The portable LED light according to claim 2, wherein the number of the support members is three.

9. The portable LED light according to claim 2, wherein the support member is provided with a support leg fixed on an end thereof where is far from the lug.

10. The portable LED light according to claim 1, wherein a first waterproof ring is provided between the rotating member and the LED light housing; and a second waterproof ring is provided between the rotating member and the handle member.

* * * * *